US010996039B1

(12) United States Patent
DeLuca et al.

(10) Patent No.: US 10,996,039 B1
(45) Date of Patent: May 4, 2021

(54) HAND-SETTABLE NET MUNITION TIME FUZE

(71) Applicant: U.S. Government as Represented by the Secretary of the Army, Dover, NJ (US)

(72) Inventors: Patrick DeLuca, Bridgewater, NJ (US); Evan Young, Sparta, NJ (US); Brent Beauseigneur, Great Meadows, NJ (US); Daniel Kelly, Morristown, NJ (US); Dexter Cook, Morris Plains, NJ (US); Tomasz Blyskal, Flemington, NJ (US); Lam Vo, Jersey City, NJ (US)

(73) Assignee: U.S. Government as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 16/774,228

(22) Filed: Jan. 28, 2020

(51) Int. Cl.
*F42C 11/06* (2006.01)
*F42C 17/04* (2006.01)
*F41H 13/00* (2006.01)

(52) U.S. Cl.
CPC ..... *F42C 11/06* (2013.01); *F41H 13/0006* (2013.01); *F42C 17/04* (2013.01)

(58) Field of Classification Search
CPC .... F42C 11/06; F42C 17/04; F42H 13/00069; F42H 13/0006
USPC ..... 102/206–210, 268, 275.9, 275.11, 277
See application file for complete search history.

(56) References Cited

U.S. PATENT DOCUMENTS

| | | | | | |
|---|---|---|---|---|---|
| 2,873,067 | A * | 2/1959 | Crowther | F42C 17/00 | 235/408 |
| 3,667,392 | A * | 6/1972 | Grantham | F42C 11/06 | 102/265 |
| 3,781,884 | A * | 12/1973 | Horton | F42C 13/04 | 102/214 |
| 3,851,531 | A | 12/1974 | White | | |
| 4,072,108 | A * | 2/1978 | Lewis | F42C 11/04 | 102/209 |
| 4,157,685 | A * | 6/1979 | Gerwin | F41G 5/14 | 102/214 |
| 4,703,693 | A * | 11/1987 | Spies | F42C 11/06 | 102/200 |
| 4,750,424 | A * | 6/1988 | Hau | F42C 17/04 | 102/200 |
| 5,265,539 | A * | 11/1993 | Kurschner | F42B 14/06 | 102/206 |
| 5,271,327 | A * | 12/1993 | Filo | F42C 11/008 | 102/202.5 |
| 5,343,795 | A | 9/1994 | Ziemba | | |
| 5,497,704 | A * | 3/1996 | Kurschner | F42C 11/06 | 102/264 |
| 5,750,918 | A | 5/1998 | Mangolds | | |
| 9,939,238 | B1 * | 4/2018 | Sowle | F42B 10/14 | |
| 10,197,365 | B1 | 2/2019 | Blyskal | | |
| 2012/0011996 | A1 * | 1/2012 | Glasson | F41H 11/04 | 89/36.17 |

(Continued)

*Primary Examiner* — Bret Hayes
(74) *Attorney, Agent, or Firm* — John P. DiScala

(57) ABSTRACT

A hand settable fuze interfaces with a servomotor to deploy a net from a projectile in flight. Prior to launch, a dial is rotated to both power on the fuze and set a preset delay. The projectile is then launched from a launcher system to deliver the stowed net rapidly and accurately toward a target. After the preset delay, the net is deployed from the projectile toward the target by operation of the servomotor.

15 Claims, 4 Drawing Sheets

(56) References Cited

U.S. PATENT DOCUMENTS

2020/0116465 A1* 4/2020 Hucker ..... F42C 11/065

* cited by examiner

HAND-SETTABLE NET MUNITION TIME FUZE

STATEMENT OF GOVERNMENT INTEREST

The inventions described herein may be manufactured, used and licensed by or for the United States Government.

FIELD OF THE INVENTION

The invention relates in general to munition fuzes and in particular to a fuze for a net munition.

BACKGROUND OF THE INVENTION

Unmanned aerial systems (UAS) are a security threat for both civilians and military personnel. UASs are increasingly being used to surveil, spot and carry out attacks against personnel and structures. The size, speed, maneuverability and widespread access to UASs all complicate efforts to protect from them. One approach that has been contemplated is the use of airborne nets to ensnare these threats. However, past attempts have not been entirely successful.

Simply dropping or launching a net at these targets can be both risky and ineffective. For example, one counter UAS technique includes dragging a net from a larger UAS in the hopes of ensnaring smaller drones in flight. Unfortunately, a major flaw in this approach is the need of a well-trained pilot to try to catch a much lighter, faster, more maneuverable UAS. This task is difficult at best.

Another technique is to shoot a net at the threat from another UAS. However, a UAS mounted net launcher would be too heavy and have limited range. As a result, it would require a larger, less maneuverable UAS to not only be in close proximity to the threat but also to be aimed accurately. The problems are compounded when trying to ensnare many, or a swarm of drones, with one net.

Another more promising approach is using a launched munition to release a net during flight. Co-owned U.S. Pat. No. 10,197,365, the entire contents of which are hereby incorporated by reference, describes one such launched net munition. By delaying release of the net until during flight, the projectile round rapidly delivers a net precisely at a target location. However, such a munition may require a fuze which is capable of interfacing with a servomotor to release a net at a desired time.

A need exists for a fuze which can be employed on a projectile to cause a servomotor to release a net at a desired time.

SUMMARY OF INVENTION

One aspect of the invention is a fuze for a projectile having a servomotor. The fuze comprises a controller and a power source. The controller is in electric communication with the servomotor to provide electric power and a control signal to the servomotor at a preset delay after launch to controllably rotate the servomotor. The electric power is not provided to the servomotor until after the preset delay. The power source supplies electric power to the controller and the servomotor.

Another aspect of the invention is a spin launched projectile for disabling a selected target by casting a net at said target. The projectile comprises a projectile body, an ogive section, a fuze, a servomotor and a net assembly. The ogive section is releasably attached at the front of the projectile body by a rotation of the servomotor. The fuze further comprises a controller, a power source and a dial. The controller is in communication with the servomotor to provide power and a control signal to the servomotor at a preset delay after a launch of the projectile. The power source provides electric power to the fuze and the servomotor. The dial is mechanically manipulated to set the preset delay and further comprises at least one magnet and at least one Hall Effect sensor for sensing a position of the dial. The net assembly further comprises the net, deployment petals attached to the net and an ejection spring aft of the net. After the preset delay, the fuze provides the control signal and electric power to the servomotor which in turn releases the ogive section. The release of the ogive section allows the ejection spring to eject the deployment petals along the net. Centripetal forces imparted by previous projectile spin forces the petals outward, opening the still spinning net which has been ejected in the path of the target.

A third aspect of the invention is a method for operating a fuze for a projectile comprising a servomotor. The method includes the steps of: receiving a rotation of a dial to a position corresponding to a preset delay of the fuze; a power source supplying power to the fuze in response to the preset delay being set; the fuze detecting a launch of the projectile; starting a countdown timer set to the preset delay; after the preset delay, applying power and a control signal to the servomotor to controllably rotate the servomotor.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

A hand settable fuze interfaces with a servomotor to deploy a net from a projectile in flight. Prior to launch, a dial is rotated to both power on the fuze and set a preset delay. The projectile is then launched from a launcher system to deliver the stowed net rapidly and accurately toward a target. After the preset delay, the net is deployed from the projectile toward the target by operation of the servomotor.

The fuze is set to one of multiple preset delays which corresponds to a distance based on known and tested launch velocities. Advantageously, the fuze is automatically powered on once the user sets the preset delay. If, however, the user decides against using the projectile, the fuze may be turned off by reversing the action. The fuze provides a visual indication of both operating status and preset delay time in the form of one or more LED lights.

Unlike traditional fuzes, the fuze interfaces with and controls a servomotor. The servomotor, in turn, causes the release of the net. Critically, and unconventionally, the fuze does not provide power to the servomotor until after gun launch when the preset delay has expired. Not only does this conserve battery power but is also critical to the proper functioning of the servomotor. It was discovered that the forces of the gun launch environment can damage the internal components of servomotors which are powered on and holding a position. Proper operation of the servomotor can be assured by delaying powering of the servomotor until after the preset delay.

Finally, the fuze is able to discriminate between launch and other impact events, such as drops or bumps. On board accelerometers detect acceleration of the projectile which is then compared to a pulse duration threshold to determine whether gun launch has occurred.

Figure 1:
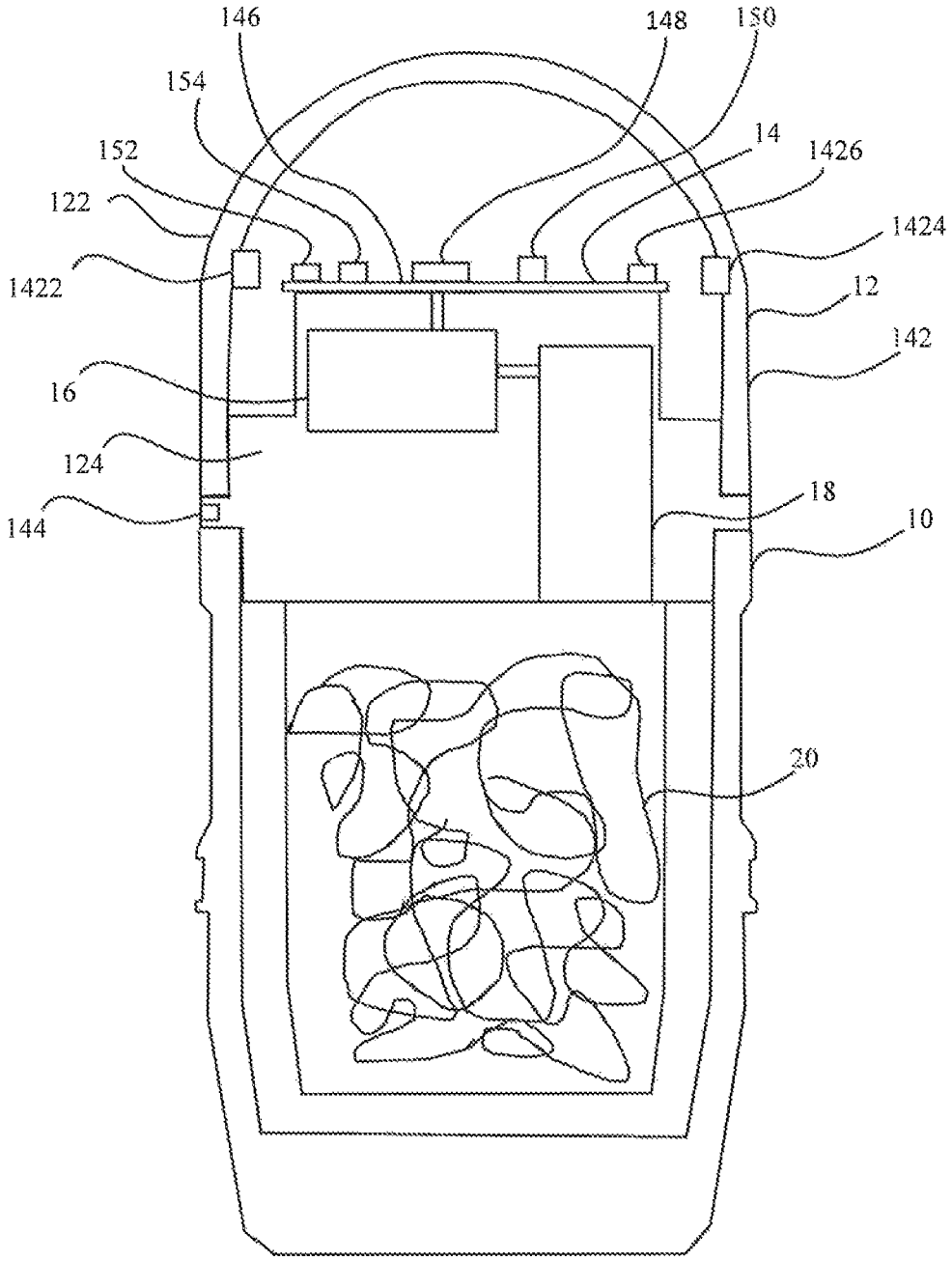
FIG. 1 is a cross section of a fuzed projectile for casting a net at a target, according to an illustrative embodiment.

FIG. 1 is a cross section of a fuzed projectile for casting a net at a target, in accordance with an illustrative embodiment. The projectile 1 rapidly delivers a net precisely at a target location, as opposed to launching the net from a comparatively large distance away from the target. In the embodiment shown, the projectile 1 is a 40 mm projectile for use in a 40 mm weapon system. However, the projectile 1 is not limited to a 40 mm projectile. Further, the projectile 1 is not limited to traditional weapon systems and may be launched from any appropriate tube using a propellant, compressed air, mechanical means or any other propulsion system.

The projectile 1 comprises a projectile body 10, an ogive 12, a fuze 14, a servomotor 16 and release mechanism 18 and a net assembly 20. Together, the projectile body 10 and ogive 12 form a housing which has a hemispherical nose and a body which is generally cylindrical in shape. The housing encloses the fuze 14, servomotor 16, release mechanism 18 and the net assembly 20.

The ogive 12 comprises a cap 122 and a lower body 124. The cap 122 is connected to the lower body 124 such that the cap 122 is free to rotate in relation to the stationary lower body 124. The lower body 124 in turn is releasably connected to the projectile body 10 via a release mechanism 18. The ogive 12 and projectile body 10 are secured together until separated by operation of the servomotor 16 which activates the release mechanism 18, as will be described in more detail below.

The fuze 14 further comprises a dial 142, a visual indicator 144 and a control board 146. The control board 146 serves as a mounting structure for a controller 148, a power source 150, a magnetic switch 152 and one or more accelerometers 154. The control board 146 itself is mounted within the housing, such as on the lower body 124 of the ogive 12.

The dial 142 receives an input which simultaneously powers on the fuze 14 and inputs the preset delay. In a preferred embodiment, the dial 142 is hand-settable for convenience. For example, in the embodiment shown, the ogive cap 122 along with associated magnets on the ogive cap 122 and magnetic sensors on the control board 146 serve as the hand settable dial 142. A user initially rotates the cap 122 relative to the lower body 124 to one of a defined position which powers on the fuze 14 and inputs the desired preset delay. The input is sensed and then input electronically by the controller 148. Return of the dial 142 to the initial position, turns the fuze 14 off for later use.

Visual markings on the ogive 12 indicate the defined positions and their corresponding preset delays. Further, a visual indicator 144 in communication with the controller 148 and provides visual feedback corresponding to operating status of the fuze 14 (i.e. on/off) and preset delay time. For example, in one embodiment, the visual indicator 144 is a blinking LED assembly with LED color indicating operation status and a frequency of blinks indicating preset delay time. Alternatively, the fuze 14 may comprise more than one LED, with each LED corresponding to a preset delay time.

A switch magnet 1422 and one or more preset delay magnets 1424 are positioned on the cap 122 of the ogive 12. A magnetic switch 152, such as a reed switch, is positioned on the control board 146, initially opposite the switch magnet 1422. Rotation of the cap 122 causes the switch magnet 1422 to rotate with respect to the magnetic switch 152. The magnetic switch 152 closes in response to the new position of the switch magnet 1422. The fuze 14 is powered on by the closing of the magnetic switch 152.

One or more Hall Effect sensors 1426 reside on the control board 146. Rotation of the cap 122 brings one or more magnets in proximity of the sensors. The Hall Effect sensors 1426 sense the position of the preset delay magnets 1424 by sensing whether a magnet 1424 is opposite the sensor. The controller 148 receives inputs from the one or more Hall sensors and sets the preset delay accordingly. The position of the magnets 1424 with respect to the Hall Effect sensors 1426 correspond to preset delays. As will be described further below, in one embodiment, the fuze 14 comprises three delay magnets 1424 and three Hall Effect sensors 1426. The position of the delay magnets 1424 in relation to the Hall Effect sensors 1426 correspond to an off position and five preset delays.

Figure 2:
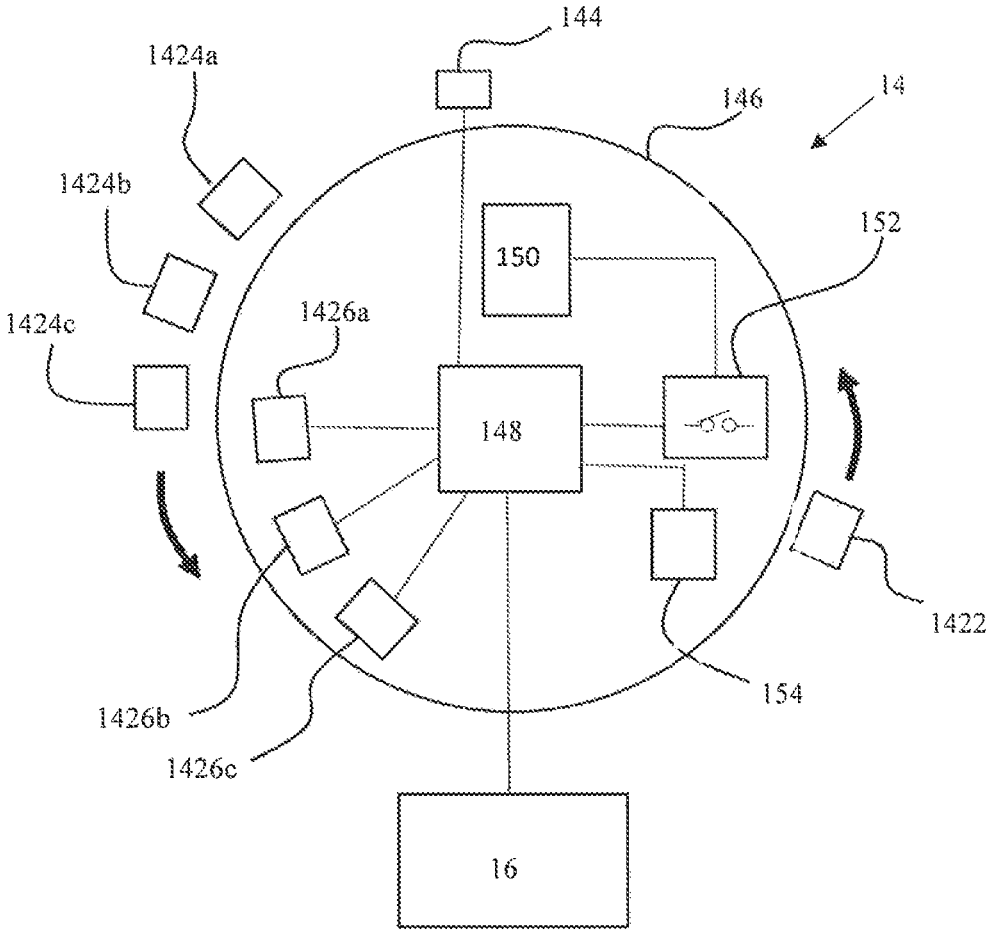
FIG. 2 is a block diagram of a fuze for a projectile, according to an illustrative embodiment.

FIG. 2 is a block diagram of a fuze for a projectile, in accordance with an illustrative embodiment. The controller 148 represents a central processing unit (CPU) and an associated memory. In the embodiment shown, the controller 148 is a microcontroller. In other embodiments, the controller 148 may be comprised of discrete components in communication. For example, the CPU may comprise one or more microprocessors, and the microprocessors may be "general purpose" microprocessors, a combination of general and special purpose microprocessors, or application specific integrated circuits (ASICs). Additionally or alternatively, the CPU may include one or more reduced instruction set (RISC) processors, video processors, or related chip sets. In this embodiment, the memory is communicably coupled to the CPU and may store data and executable code. The memory comprises volatile memory such as RAM, but may also include nonvolatile memory, such as read-only memory (ROM) or Flash memory.

The controller 148 is electrically connected to the power source 150 via the magnetic switch 152 and receives electric power from the power source 150 when the magnetic switch 152 is closed. The controller 148 receives inputs from both the Hall Effect sensors 1426 and the accelerometers 154. The controller 148 provides electric power and a control signal to the servomotor 16 according to the inputs received from the Hall Effect sensors 1426 and accelerometers 154. Upon being powered on, the controller 148 determines a preset delay according to the inputs from the Hall Effect sensors 1426. The controller 148 detects gun launch according to the sensed input received from the accelerometer 154. Once gun launch is detected, the controller 148 begins a countdown. The controller 148 provides power and a control signal to the servomotor 16 when the countdown reaches the preset delay.

The power source 150 provides electric power to the controller 148 and to the servomotor 16 via the controller 148. In an embodiment, the power source 150 is an electric battery, such as a lithium ion battery. In further embodiments, the electric battery is configured to be recharged.

Those skilled in the art will appreciate that battery life is a critical attribute of the fuze 14. Given this, the fuze 14 conserves battery life by selectively powering the controller 148 and the servo. The controller 148 is only powered once the magnetic switch 152 is closed via the hand-settable dial 142. The servo is only powered just prior to deployment of the net, once the munition has been launched and the preset delay has been met. In addition, power may be turned off and conserved by returning the dial 142 to its initial position.

The magnetic switch 152 activates the fuze 14 by completing the circuit between the power source 150 and the controller 148. As described above, the magnetic switch 152 is closed via movement of the associated switch magnet to a position relative to the magnetic switch 152. In the embodiment described herein, this is done simultaneously with the inputting of the preset delay by rotating the hand settable dial 142. Rotation of the switch magnet to its initial position will deactivate the fuze 14 by opening the magnetic switch 152 and the power circuit to the controller 148.

Figure 3:
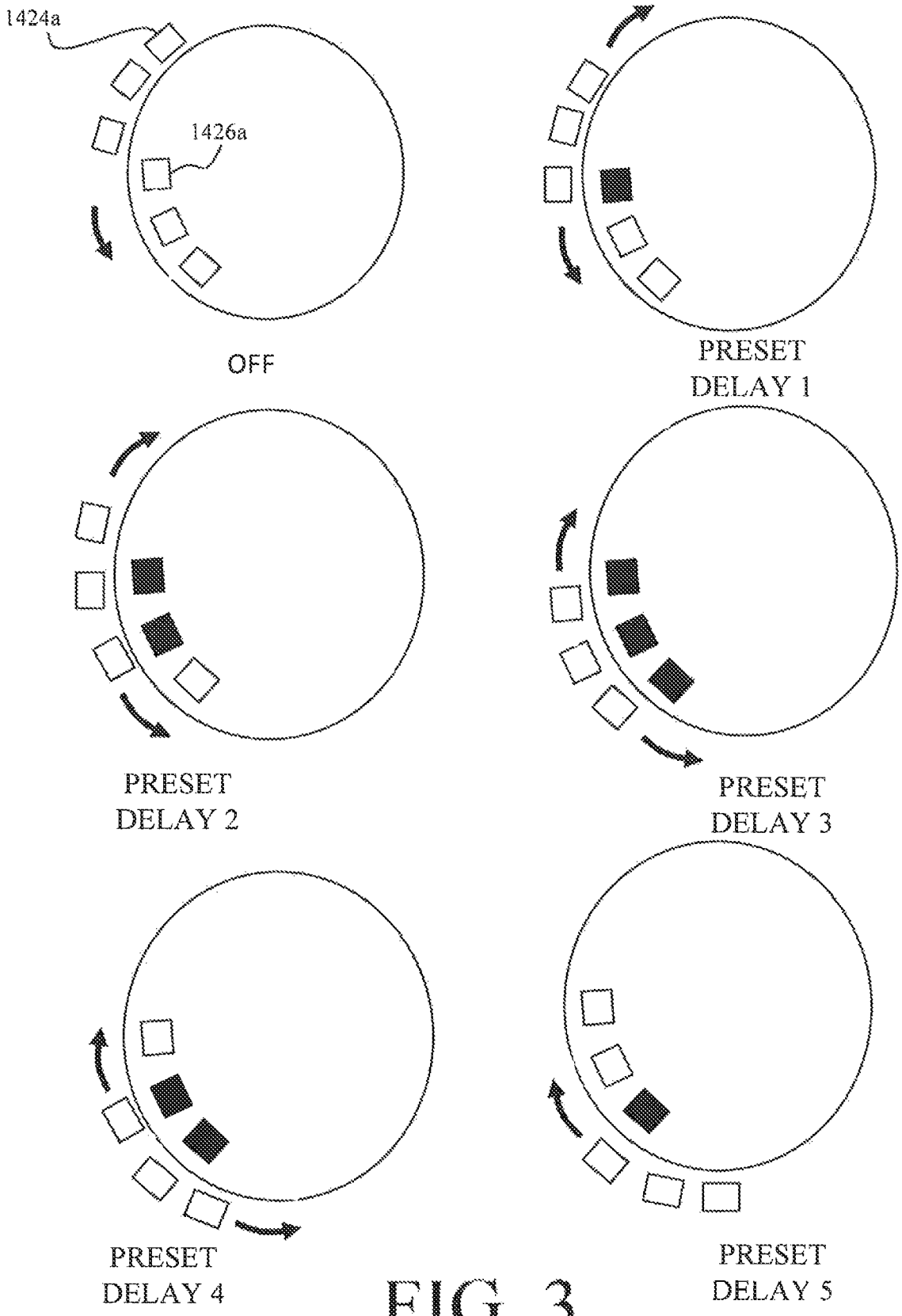
FIG. 3 shows six positions of a hand-settable dial, according to an illustrative embodiment.

FIG. 3 shows six positions of a hand-settable dial, according to an illustrative embodiment. The Hall Effect sensors 1426 sense the position of the preset delay magnets 1424 and provide this sensed information to the controller 148. The controller 148 determines a preset delay according to the sensed information. In the embodiment shown, depending on location of the dial 142, there are six possible states of the three Hall Effect sensors 1426 which correspond to an off position and the five preset delays. In this embodiment, the Hall Effect sensor 1426 provides the controller 148 with sensed information corresponding to whether a magnet is in a position proximate the sensor.

The accelerometer 154 senses the acceleration of the fuze 14 and provides the sensed information to the controller 148. The controller 148 determines whether gun launch has occurred according to the acceleration information provided by the accelerometer 154. When the acceleration of the fuze 14 exceeds a threshold magnitude for a threshold duration, the controller 148 determines that gun launch has occurred. This is critical, as the controller must accurately discriminate between the loading of the munition into the gun and the firing of the system.

The controller 148 selectively provides both electric power and a control signal to the servomotor 16. Critically, the controller 148 does not provide the electric power to the servo until after gun launch and the preset delay counter. By not providing power to the servomotor 16 until after the preset delay, the servomotor 16 is functionally more reliable.

Figure 4:
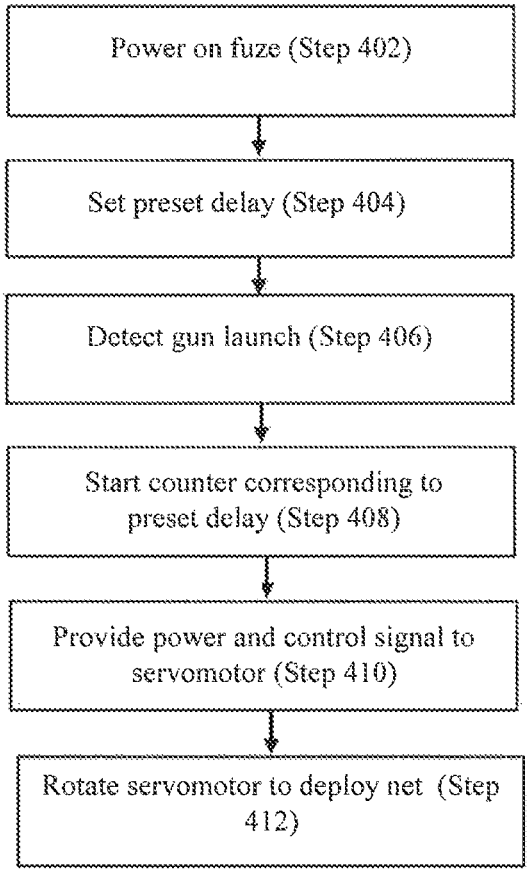
FIG. 4 is a flowchart illustrating a method for operating a fuze, according to an illustrative embodiment.

FIG. 4 is a flowchart illustrating a method for operating a fuze, in accordance with an illustrative embodiment. In step 402, the fuze 14 is powered on. An input is received by the fuze 14 which closes the magnetic switch 152. In the embodiment described herein, the hand settable dial 142 is rotated which in turn positions a magnet such that the magnetic switch 152 closes. The closed magnetic switch 152 completes the circuit between the power source 150 and the controller 148, thereby providing electric power to the controller 148.

In step 404, the controller 148 sets the preset delay. An input is received by the fuze 14 which inputs the preset delay. Preferably, this is done simultaneous to the fuze 14 being powered on with a rotation of the hand settable dial 142. In the embodiments described here, the hand settable dial 142 is turned to a position which is sensed by one or more Hall Effect sensors 1426. The controller 148 sets a preset delay according to the sensed information received from the Hall Effect sensors 1426.

In step 406, the controller 148 detects a gun launch event. One or more accelerometers 154 sense the acceleration of the fuze 14 and provide this information to the controller 148. The controller 148 first determines whether the acceleration magnitude is greater than an acceleration threshold. For acceleration events in which the magnitude of acceleration is greater than the acceleration threshold, the controller 148 then determines whether the duration of the pulse is greater than a threshold pulse duration. It was experimentally determined for this type of round that the pulse duration of drop events is narrower than the pulse duration for gun launch events. A pulse duration threshold was selected based on the experimental data. If the width of the pulse duration as determined by the controller 148 exceeds the pulse duration threshold, the controller 148 determines that a gun launch event has occurred.

In step 408, the controller 148 starts a counter corresponding to the preset delay. Once gun launch is detected, the controller 148 starts a counter set to the length of the preset delay.

In step 410, the controller 148 provides power and a control signal to the servo. Upon the counter expiring, the controller 148 provides power to the servomotor. In addition, the controller 148 provides a control signal to be carried out by the servomotor. The control signal is a pulse width modulated (PWM) signal which instructs the servomotor to rotate a certain amount.

In step 412, the servomotor rotates in response to the control signal. The servomotor rotates according to the control signal provided by the controller 148. The rotation of the servomotor causes the release mechanism 18 to release the ogive 12 from the lower body 124 and deploying the net from the munition. In one embodiment, the servomotor pulls on a central lock release plunger to in turn release a ball lock mechanism.

While the invention has been described with reference to certain embodiments, numerous changes, alterations and modifications to the described embodiments are possible without departing from the spirit and scope of the invention as defined in the appended claims, and equivalents thereof.

What is claimed is:

1. A fuze for a projectile with a servomotor, the fuze comprising:
   - a controller in communication with the servomotor to provide electric power and a control signal to the servomotor after a preset delay after a launch to controllably rotate the servomotor wherein electric power is not provided to the servomotor until after the preset delay;
   - a power source for supplying electric power to the fuze and the servomotor; and
   - a dial for mechanically inputting the preset delay and wherein the preset delay is determined by a position of the dial and wherein the dial further comprises a magnet and a Hall effect sensor for sensing the position of the dial.

2. The fuze of claim 1 herein the dial comprises three magnets and three Hall effect sensors, the positions of which in relation to each other correspond to five preset delays.

3. The fuze of claim 1 wherein the fuze further comprises an accelerometer in communication with the controller for detecting the launch.

4. The fuze of claim 3 wherein the controller discriminates between the launch and an impact event from data received from the accelerometer.

5. The fuze of claim 1 wherein the fuze further comprises one or more visual indicators to indicate the preset delay.

6. The fuze of claim 1 wherein the power supply does not supply power to the fuze until activated by inputting the preset delay.

7. The fuze of claim 6 further comprising a magnetic switch positioned between the power source and the controller and wherein the magnetic switch is closed by inputting the preset delay.

8. A spin launched projectile for disabling a selected target by casting a net at said target, the projectile comprising:

a projectile body;

an ogive section releasably attached at the front of said projectile body by a rotation of a servomotor;

a fuze further comprising a controller in communication with the servomotor to provide power and a control signal to the servomotor at a preset delay after a launch of the projectile wherein power is not provided to the servomotor until after the preset delay, a power source for providing electric power to the fuze and the servomotor and a dial for mechanically inputting the preset delay and further comprising at least one magnet and at least one Hall effect sensor for sensing a position of the dial;

a net assembly further comprising the net, deployment petals attached to said net and an ejection spring aft of the net; and wherein after the preset delay, the fuze provides the control signal and electric power to the servomotor which in turn releases the ogive section which allows the ejection spring to eject the deployment petals along the net and wherein centripetal forces imparted by previous projectile spin forces the petals outward, opening the still spinning net which has been ejected in the path of the target.

9. The fuze of claim 8 wherein the fuze further comprises an accelerometer and wherein the controller discriminates between the launch and an impact event from data received from the accelerometer.

10. The fuze of claim 8 wherein the fuze further comprises one or more visual indicators to indicate the preset delay.

11. The fuze of claim 8 wherein the power supply does not supply power to the fuze until activated by inputting the preset delay.

12. A method for operating a fuze for a projectile comprising a servo, the method comprising the steps of:

a magnet disposed on the fuze rotating to a position sensed by a Hall effect sensor and corresponding to a preset delay of the fuze;

a power source supplying power to the fuze in response to the preset delay being input;

the fuze detecting a launch of the projectile;

starting a countdown timer set to the preset delay;

after the preset delay, applying power and a control signal to the servomotor to controllably rotate the servomotor.

13. The method of claim 12 further comprising the step of illuminating a visual indicator to indicate operating status and preset delay.

14. The method of claim 12 wherein the step of the fuze detecting a launch of the projectile further comprises the steps of:

sensing an acceleration pulse of the fuze;

determining the width of the acceleration pulse;

comparing the width to a pulse width threshold;

categorizing the acceleration pulse as corresponding to a gun launch if the width exceeds the pulse width threshold.

15. The method of claim 12 wherein the step of a power source supplying power to the fuze in response to the preset delay being input further comprises the step of:

a switch positioned between a power supply and the controller being closed by an action of setting the preset delay.

* * * * *